US007569121B2

(12) United States Patent
Devore

(10) Patent No.: US 7,569,121 B2
(45) Date of Patent: Aug. 4, 2009

(54) PROCESS FOR PRODUCING SYNTHETIC OIL FROM SOLID HYDROCARBON RESOURCES

(76) Inventor: Clyde Wesley Devore, 9808 3rd Street Rd., Louisville, KY (US) 40272

( * ) Notice: Subject to any disclaimer, the term of this patent is extended or adjusted under 35 U.S.C. 154(b) by 723 days.

(21) Appl. No.: 11/095,108

(22) Filed: Mar. 31, 2005

(65) Prior Publication Data

US 2006/0219544 A1 Oct. 5, 2006

(51) Int. Cl.

| | |
|---|---|
| ***C10B 49/06*** | (2006.01) |
| ***C10B 17/00*** | (2006.01) |
| ***C10B 51/00*** | (2006.01) |
| ***C10B 49/00*** | (2006.01) |

(52) U.S. Cl. ..... 201/32; 201/10; 201/96; 202/96; 208/80; 208/411; 208/414; 208/416; 208/418; 208/419; 208/434; 44/13; 44/30

(58) Field of Classification Search ..... 208/80, 208/411, 414, 416, 418, 419, 434; 201/10, 201/32, 96; 44/13, 30; 202/96
See application file for complete search history.

(56) References Cited

U.S. PATENT DOCUMENTS

| | | | | |
|---|---|---|---|---|
| 2,694,623 | A | | 11/1954 | Welty, Jr., et al. |
| 4,166,786 | A | | 9/1979 | Duraiswamy et al. |
| 4,169,128 | A | | 9/1979 | Sinor et al. |
| 4,213,826 | A | | 7/1980 | Eddinger et al. |
| 4,341,598 | A | | 7/1982 | Green |
| 4,373,994 | A | | 2/1983 | Lee |
| 4,415,339 | A | | 11/1983 | Aiman et al. |
| 4,448,588 | A | | 5/1984 | Cheng |
| 4,477,257 | A | * | 10/1984 | Koppelman et al. ..... 44/632 |
| 4,900,429 | A | | 2/1990 | Richardson |
| 5,171,406 | A | | 12/1992 | Shang et al. |
| 5,327,726 | A | | 7/1994 | Daman et al. |
| 5,547,549 | A | | 8/1996 | Fraas |
| 5,961,786 | A | | 10/1999 | Freel et al. |
| 6,419,856 | B1 | | 7/2002 | Cirrito et al. |
| 6,510,695 | B1 | | 1/2003 | Fisher |

* cited by examiner

*Primary Examiner*—Glenn Caldarola
*Assistant Examiner*—Prem C. Singh
(74) *Attorney, Agent, or Firm*—Joan L. Simunic

(57) ABSTRACT

The present development is a multistage process for converting solid hydrocarbon resources into synthetic oil. The process comprises a raw hydrocarbon material treatment stage, followed by a pyrolysis stage, and then a synthetic liquid upgrading stage. Throughout the process, heat is transferred to the hydrocarbon resources via recyclable ceramic spheres.

12 Claims, 2 Drawing Sheets

PROCESS FOR PRODUCING SYNTHETIC OIL FROM SOLID HYDROCARBON RESOURCES

BACKGROUND

The present development is a multistage process for converting solid hydrocarbon resources, such as coal, oil shale and biomass, into synthetic oil. Raw hydrocarbon material is initially treated in a pre-heater and dryer system. The treated material is then subjected to pyrolysis conditions. The raw liquids generated by the pyrolysis conditions are then exposed to upgrading conditions to isolate the desired synthetic oil.

The Department of Energy and other commercial entities have expressed an interest in identifying ways to product marketable hydrocarbon liquids, such as synthetic oil, from coal, oil shale and biomass. However, this has not yet been accomplished at affordable cost.

There are basically two methods for extracting synthetic liquids from hydrocarbon resources: liquefaction and pyrolysis. Liquefaction, a process which converts solid mass to liquid hydrocarbon, requires relatively high reaction temperatures and pressures. Pyrolysis, a process which strips valuable liquid hydrocarbon from a solid but leaves a solid residue or char, can operate at more moderate temperatures and lower pressures, such as atmospheric pressure. Thus, although liquefaction produces more of the desired liquid hydrocarbon than pyrolysis, the reaction conditions make liquefaction a high cost operation.

In the prior art, attempts have been made to improve liquefaction processes. For example, the processing material may be pretreated, or the processing material may be mixed with oils which are expected to serve as hydrogen donors during processing, or the material may be processed in a hydrogen-rich atmosphere under elevated pressure. These processing variations have increased the yield and quality of the synthetic liquids produced, but at high operating costs because of the need for expensive equipment and large energy consumption.

Similarly, the prior art cites attempts to improve pyrolysis processes. In particular, there is a need to improve yield, quality—the resultant oil often contains dust and ash—and to eliminate or reduce the number of carbon deposits formed during operation. It is known that the material to be processed can be heated with hot recycled ash or by partial combustion of some of the hydrocarbon material. However, the hot ash is very active and when used for heating raw material to pyrolysis temperature some of the vaporized synthetic oil is carbonized on the ash, thereby reducing the yield of hydrocarbon liquids. When partial combustion is used for heating, the product gases of combustion, primarily nitrogen, carbon dioxide, water vapor and carbon monoxide, dilute the desired hydrocarbon product vapors, thereby requiring costly separation stages.

The present development addresses the problems presented by the liquefaction and the pyrolysis processes by using standard boiler-type designs for handling large amounts of hydrocarbon material to produce very large quantities of synthetic hydrocarbon liquids at affordable prices.

SUMMARY OF THE PRESENT INVENTION

The present development is a multistage process for converting solid hydrocarbon resources into synthetic oil. The process comprises three stages: raw hydrocarbon material is treated in a pre-heater and dryer system; the hydrocarbon heated material is pyrolyzed; and, the raw synthetic liquids are upgraded, such as through thermal cracking. Throughout the process, heat is transferred to the hydrocarbon resources via recyclable ceramic spheres.

DETAILED DESCRIPTION OF THE INVENTION

The present development is a multistage process for the production of synthetic oil from solid hydrocarbon resources, such as without limitation coal, oil shale, tar sands, biomass and combinations thereof The process may be operated at coal burning facilities, such as power plants to pre-process coal for producing synthetic oil before combustion. Relative to the prior art, the current process is more economical because energy is conserved increasing operational thermal efficiency. Further, the liquefaction system is designed to extract the most cost effective hydrocarbon liquids and gases from the hydrocarbon material prior to combustion. It is unnecessary for the pyrolysis system to be constructed to consume all the hydrocarbon material because the residual char and unused gases are combusted in boilers to power steam turbines. Alternatively, the char may be used in partial oxidation processes to produce combustible gas to operate a combined cycle gas turbine/steam turbine.

Figure 1:
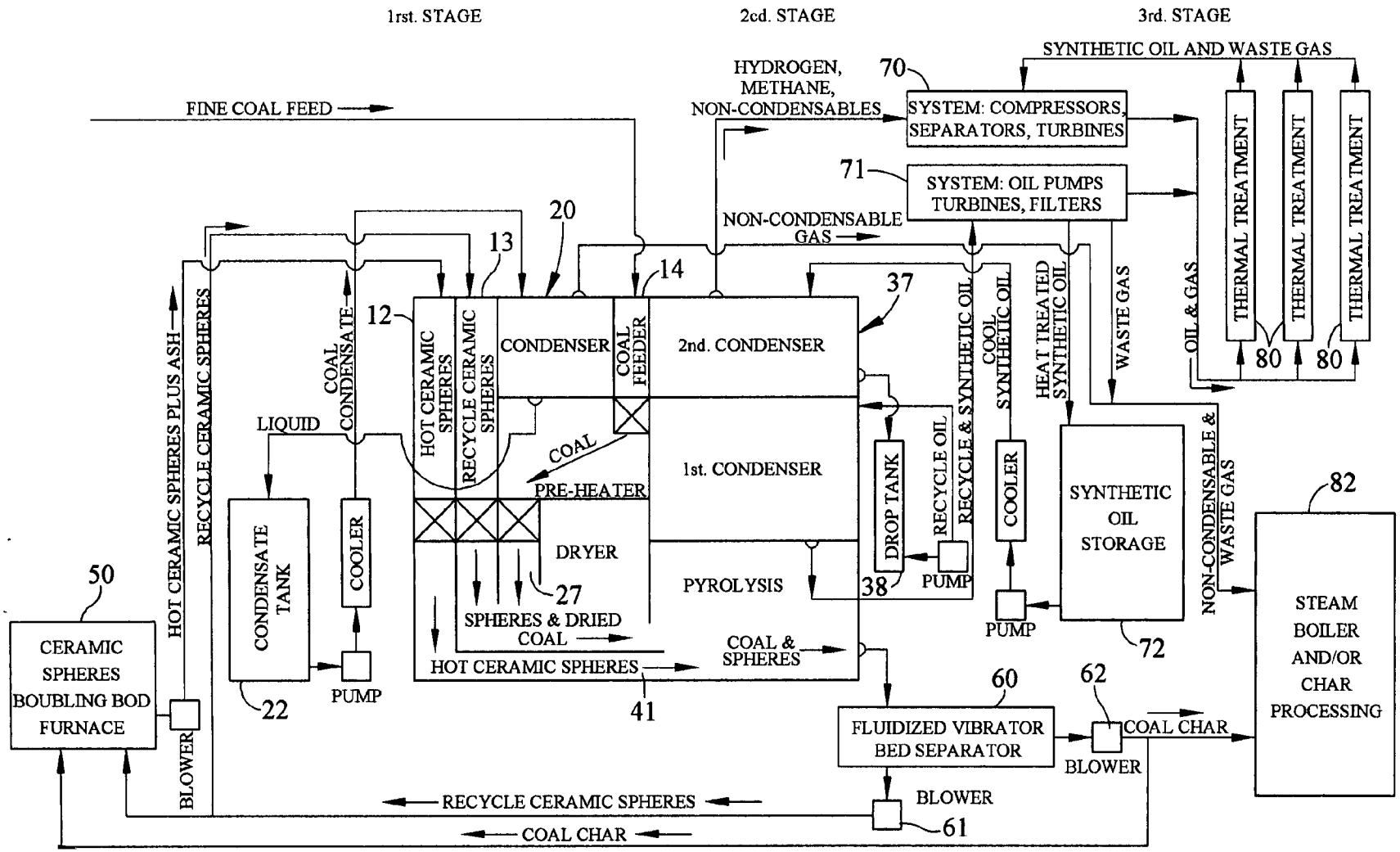
FIG. 1 is a schematic of a process designed according to the present invention.
Figure 2:
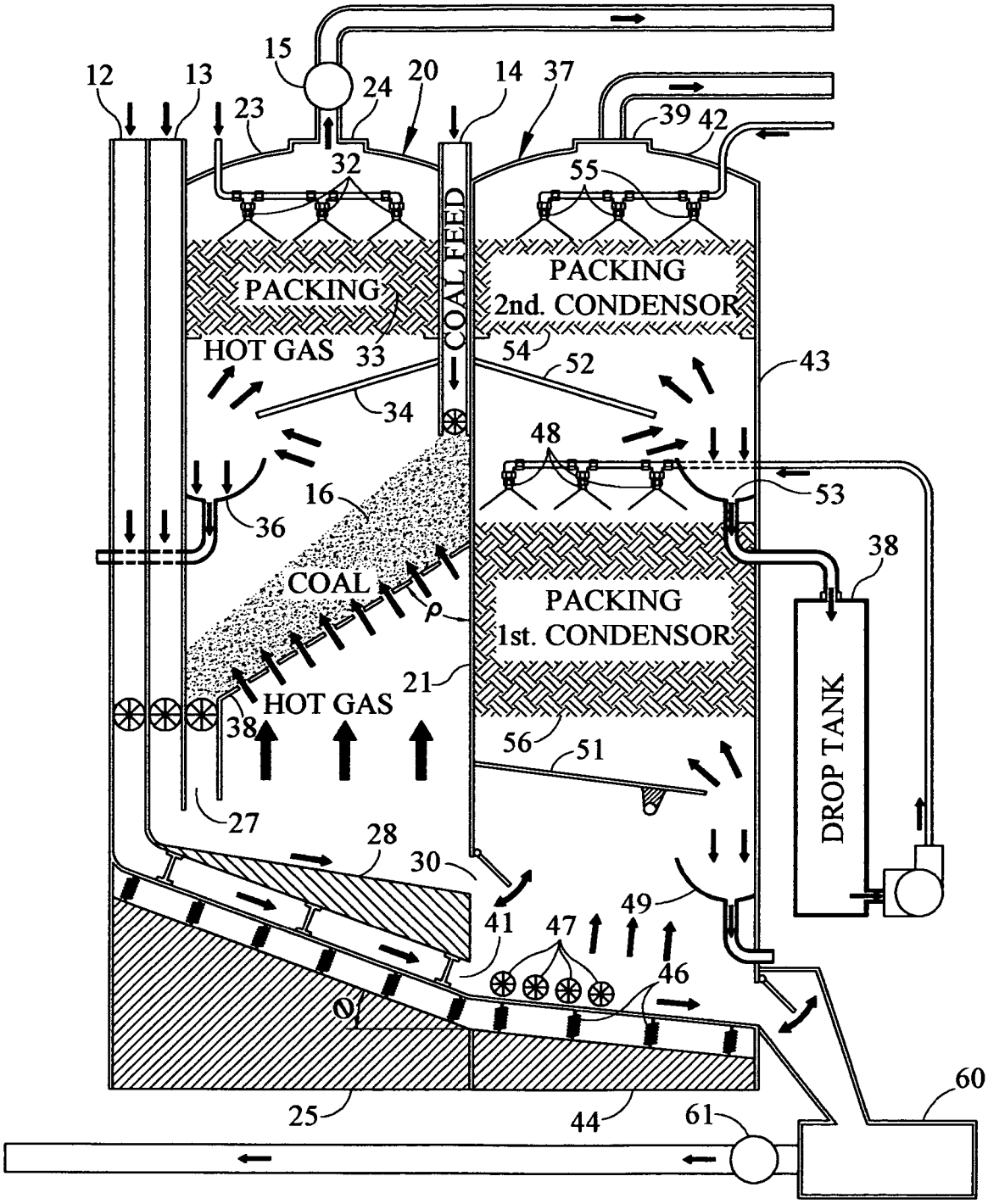
FIG. 2 is a cut-away schematic view of a raw coal treatment unit, a condenser, fluidizing vibrating separator and furnace for use in the process of FIG. 1.

The process, shown in schematic form in FIG. 1, comprises a raw solid hydrocarbon preheating stage, a pyrolysis stage, and a raw synthetic liquids upgrading stage. FIG. 2 is a schematic cut-away view of the apparatus used to carry out the process of FIG. 1. Throughout the process, raw coal is fed through the various stages in the presence of heated ceramic spheres that serve to transfer the heat needed for pyrolysis to the coal.

Referring to FIGS. 1 and 2, the raw solid hydrocarbon preheating stage, or stage 1, comprises a hot ceramic sphere feeder tube 12, a recycled ceramic sphere feeder tube 13, a raw solid hydrocarbon feeder tube 14, a raw solid hydrocarbon treatment unit 20 and a storage tank 22. As shown in FIG. 2, the treatment unit 20 has a top 23 with a vent 24, a base 25 and a sidewall 21. At a predetermined position in the sidewall 21, a fine mesh screen unit 38 is mounted at an angle ρ to the sidewall 21, the screen unit being mounted between a vibrating dryer bed 28 and a plurality of nozzles 32 and terminating with a feed chute 27 affixed such that feed material can move through the feed chute 27 and onto the dryer bed 28 mounted to the base 25.

During operation, raw solid hydrocarbon 16 enters the treatment unit 20 through the feeder tube 14 and is then preheated to about 200° F. by hot gas as the hydrocarbon 16 flows toward the feed chute 27. As the preheated hydrocarbon 16 exits feed chute 27 it is combined with recycled ceramic spheres at a temperature of from about 1000° F. to about 1200° F. exiting from feeder tube 13. The preheated hydrocarbon 16 and recycled ceramic spheres feed onto a vibrating bed 28 and toward an exit chute 30. To facility the movement of the material along the bed 28 toward the exit chute 30, the bed 28 is mounted at an inclined angle ϕ. In a preferred embodiment, the combination of the raw coal and recycled ceramic spheres allow the dryer bed to operate at a temperature of from about 550° F. to about 600° F.

Affixed at or near the top 23 of the treatment unit 20 are the spray nozzles 32 directed to spray through a condenser section 33 and toward the dryer bed 28. Within the treatment unit 20 and at a predetermined distance from the top 23 is mounted a solid baffle 34. As vaporized volatile materials move toward the top 23 of the treatment unit 20, the volatile material is cooled with an oily liquid sprayed from the nozzles 32 condensing some of the vaporized volatile material and forming a condensate. The volatile material that is not condensed in condenser section 33, being mostly carbon monoxide, is pulled through the top vent 24 by an exhaust blower 15. The vented material is piped to a steam boiler and/or char process unit 82. To maximize efficiency, the source of the oily liquid spray is condensate previously collected in the storage tank 22. The baffle 34 serves to trap the condensates and other liquid and directs them toward a collector funnel 36 mounted through the sidewall of the treatment unit 20 with adequate plumbing to feed into the storage tank 22.

Within the lower half of the treatment unit 20 is the screen unit 38. The screen 38 has a mesh with large enough pores that volatile gases emitted by the hydrocarbon material during drying can pass through the screen 38. The gases then pass through the material 16, heating the hydrocarbon material 16 to around 200° F.

Referring again to FIGS. 1 and 2, the pyrolysis stage or stage 2, comprises a pyrolysis unit 37, a drop tank 38, a fluidized vibrating separator 60 and a ceramic spheres furnace 50. The pyrolysis unit 37 has a top 42 with a vent 39, a base 44 and a sidewall 43. At a predetermined position in the sidewall 43, the exit chute 30 enters the pyrolysis unit 37 through the sidewall 21 and feeds solid material from the treatment unit 20 onto a pyrolyzing vibrating tray 46. A separate supplementary feed chute 41 simultaneously feeds a second stream of ceramic spheres heated in the furnace 50 to a temperature of from about 1300° F. to about 1400° F. onto the pyrolyzing tray 46. The pyrolyzing tray 46 has mixer screws or paddles 47 to induce rapid mixing. In a preferred embodiment, a sufficient amount of the hot ceramic spheres from feed chute 41 are mixed with the solid material from exit chute 30 to heat the solid mixture to from about 1000° F. to 1200° F.

In the space between the top 42 of the pyrolysis unit 37 and the pyrolyzing tray 46 are located two condenser sections 54, 56. An upper condenser section 54 is located near the top 42 of the pyrolysis unit 37 and comprises a plurality of upper spray nozzles 55 mounted proximal to the top 42. An upper baffle 52 effectively separates the upper condenser section 54 from a lower condenser section 56. Similar to the upper condenser section 54, the lower condenser section 56 comprises a plurality of lower spray nozzles 48. Further, the lower condenser section 56 includes an upper funnel 53 positioned adjacent to the sidewall 43 and situated so as to receive liquid condensates from the upper baffle 52. A lower baffle 51 effectively separates the lower condenser section 56 from the pyrolyzing tray 46 and a lower funnel 49 is mounted to the sidewall 43 and situated so as to receive liquid condensates from the lower baffle 51. The funnels 49, 53 exit through the sidewall 43. The upper funnel 53 is connected to the drop tank 38. The lower funnel 49 is connected to a processing unit 71.

As the temperature of the hydrocarbon material increases to the pyrolysis temperature, hot volatile material vaporizes and rises from the pyrolyzing tray 46. The vaporized material moves around the lower baffle 51 and into the lower condenser section 56. A soot blower 58 directs blasting steam onto surfaces such as the lower baffle 51 and the lower funnel 49 to prevent carbon buildup that can obstruct the flow of hot vaporized material from the pyrolyzing tray 46 to the condensing section 56. As the volatile material rises toward the spray nozzles 48 of the lower condenser section 56, recycled oil from the drop tank 38 is sprayed by the nozzles 48 onto the rising volatiles cooling them and thereby forming synthetic liquid. The synthetic liquid flows toward and into funnel 49, where it is fed to the synthetic liquids upgrading stage or third stage of the development. The product vapors that are not condensed in the lower condenser section 56 rise past the upper baffle 52 and enter into the upper condenser section 54. The volatiles rise toward the upper spray nozzles 55 which spray cool oil from storage tank 72 into the rising vapors further cooling the volatiles and condensing the remaining synthetic liquids that can be condensed at temperatures around ambient conditions. The synthetic liquid from tank 72 and the synthetic liquid product condensed in the upper condenser section 54 flows toward and into funnel 53 and then to the drop tank 38. The volatile material that is not condensed in upper condenser section 54, primarily hydrogen and methane, is pulled through the exit vent 39 and is piped to a thermal treatment unit 70. The synthetic liquids collected in the drop tank 38 are used in the spray nozzles 48 of the lower condenser section 56. The cool oil used in the upper nozzles 55 from the synthetic oil storage tank 72 is oil that has been upgraded in the thermal treatment vessels before being stored in the tank 72.

Feed materials which are not volatilized in the pyrolysis unit 37 and the ceramic spheres are fed from the tray 46 into the fluidized vibrating separator 60. The separator 60 effectively separates the hydrocarbon char from the ceramic spheres. The char is then fed to a pneumatic blower conveying system 62. A small part of the hydrocarbon is directed from the blower conveyer system 62 to the ceramic spheres furnace 50 for reheating fuel. The remainder of the char is conveyed by blower 62 to a processing unit 82 that can either be a steam boiler for operating a steam turbine for power generation or a char processing unit for producing gas to operate a combined cycle gas turbine/steam turbine for power generation. The ceramic spheres separated by the fluidized separator 60 are fed to a conveying blower 61. The conveying blower 61 recycles the spheres back to either the recycled ceramic sphere feeder tube 13 without further heating or to the ceramic spheres furnace 50 for reheating to a temperature of from about 1300° F. to 1400° F. The reheated spheres are then sent to the hot spheres feeder tube 12, which feeds through to chute 41 of the pyrolysis unit.

The synthetic liquids collected in lower funnel 49 is filtered and pumped to the processing unit 71 where they are pumped up to very high pressure by multistage high-pressure pumps. Simultaneously, the uncondensed vapors exiting vent 39 of the pyrolysis unit 37 is sent to the thermal treatment unit 70 where they are cooled and compressed in several stages to conserve electrical power. The highly compressed gas is then combined with the high-pressure synthetic liquids and the combination is heated to the desired temperature and sent to thermal treatment vessels 80. In the process to conserve energy and power, useful energy may be recovered by heat exchangers, and power reclaiming turbines may be used to recovery electrical power during the process of reducing the pressure and temperature of the upgraded synthetic liquids leaving the thermal treatment vessels 80.

By using recyclable ceramic spheres to heat the raw hydrocarbon and hydrocarbon residue throughout the process, the process of the present development reduces industrial waste. Further, the char generated from the raw hydrocarbon after the higher value volatile components are removed can be burned in boilers to provide energy to heat the ceramic spheres. The result is a highly efficient system for the production of synthetic oil from raw coal.

What is claimed is:

1. A process for the production of synthetic oil from solid hydrocarbon resources, the process comprising:

(a) feeding the solid hydrocarbon into a treatment unit through a feeder tube and onto a fine mesh screen;

(b) preheating the solid hydrocarbon as the hydrocarbon flows along the screen toward a feed chute and creating vaporized volatile materials that flow toward a vent mounted at the top of said treatment unit;

(c) cooling the volatile materials with an oily liquid sprayed from a plurality of nozzles mounted near the top of said treatment unit forming condensates and first residual volatiles, the nozzles being fed from a storage tank;

(d) venting the first residual volatiles through the vent and into an end processing unit, and trapping the condensates with a baffle mounted between the nozzles and the screen that feeds into a collector funnel that is plumbed to the storage tank;

(e) combining the preheated hydrocarbon with recycled ceramic spheres from a recycled sphere feeder tube on a vibrating dryer bed;

(f) feeding the preheated hydrocarbon and recycled ceramic spheres into a pyrolysis unit;

(g) heating said solid hydrocarbon resource to a pyrolysis temperature to cause volatile material to vaporize and rise from the pyrolyzing tray;

(h) cooling the volatile material with recycled oil from a drop tank that is sprayed from a plurality of spray nozzles and causing the volatiles to form a first synthetic liquid;

(i) directing said first synthetic liquid into a funnel and then into a processing unit, and allowing any residual volatiles to rise toward the top of said pyrolysis unit;

(j) cooling the residual volatile material with oil from a synthetic oil storage tank that is sprayed from a plurality of spray nozzles and causing the volatiles to form a second synthetic liquid that is directed into said drop tank and a second residual volatile material mixture;

(k) venting said second volatile materials to a thermal treatment unit;

(l) feeding residual solid hydrocarbon and said ceramic spheres into a fluidized vibrating separator; and (m) separating said residual solid hydrocarbon from said ceramic spheres, and directing said hydrocarbon to a pneumatic blower conveying system and then to a solids processing unit, and directing said ceramic spheres to a conveying blower and then to a ceramic spheres furnace.

2. The process of claim 1 wherein the solid hydrocarbon is preheated to about 200° F. with a hot gas.

3. The process of claim 1 wherein the recycled ceramic spheres entering through feeder tube 13 at a temperature of from about 1000° F. to about 1200° F.

4. The process of claim 1 wherein the combination of the raw hydrocarbon and the recycled ceramic spheres allow the dryer bed to operate at a temperature of from about 550° F. to about 600° F.

5. The process of claim 1 wherein a separate supplementary feed chute feeds a second stream of ceramic spheres heated in the furnace to a temperature of from about 1300° F. to about 1400° F. onto the pyrolyzing tray.

6. The process of claim 1 wherein said pyrolyzing tray has mixer screws or paddles to induce rapid mixing.

7. The process of claim 1 wherein a sufficient amount of the hot ceramic spheres from feed chute are mixed with the solid material from exit chute, including the dried coal, to heat the solid mixture to from about 1000° F. to 1200° F.

8. The process of claim 1 wherein said solids processing unit is a steam boiler for operating a steam turbine for power generation.

9. The process of claim 1 wherein said solids processing unit is a char processing unit for producing gas to operate a combined cycle gas turbine/steam turbine for power generation.

10. The process of claim 1 wherein said processing unit further treats the first synthetic liquid from step 8 (i) by pumping said first synthetic liquid to very high pressure by multistage high-pressure pumps to create a high-pressure synthetic liquid.

11. The process of claim 1 wherein said thermal treatment unit further treats said volatile materials by cooling and compressing to create a highly compressed gas.

12. The process of claim 10 wherein said high-pressure synthetic liquid is upgraded by being combined with a highly compressed gas and then heating and being fed to at least one thermal treatment vessel.

* * * * *